US008126365B2

(12) United States Patent
Nishida et al.

(10) Patent No.: US 8,126,365 B2
(45) Date of Patent: Feb. 28, 2012

(54) BELT ROTATING APPARATUS AND RECORDING APPARATUS

(75) Inventors: Toru Nishida, Kanagawa (JP); Susumu Kibayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 652 days.

(21) Appl. No.: 12/266,648

(22) Filed: Nov. 7, 2008

(65) Prior Publication Data

US 2009/0202275 A1 Aug. 13, 2009

(30) Foreign Application Priority Data

Feb. 12, 2008 (JP) ..... 2008-031151

(51) Int. Cl.
*G03G 15/00* (2006.01)

(52) U.S. Cl. ..... 399/165; 399/288; 399/302; 399/308

(58) Field of Classification Search ..... 399/165, 399/278, 288, 302, 308
See application file for complete search history.

(56) References Cited

U.S. PATENT DOCUMENTS

| | | | | |
|---|---|---|---|---|
| 5,019,864 | A * | 5/1991 | Blanding | 399/165 |
| 5,091,752 | A * | 2/1992 | Okada | 399/329 |
| 5,347,348 | A * | 9/1994 | Nagata | 399/329 |
| 5,464,168 | A * | 11/1995 | Baker et al. | 242/530.1 |
| 6,141,526 | A | 10/2000 | Ikeda | |
| 2005/0002693 | A1 * | 1/2005 | Pak et al. | 399/165 |
| 2006/0120757 | A1 * | 6/2006 | Park et al. | 399/165 |
| 2008/0267673 | A1 * | 10/2008 | Tao et al. | 399/302 |
| 2008/0310891 | A1 * | 12/2008 | Mochizuki | 399/302 |
| 2009/0060576 | A1 * | 3/2009 | Tao et al. | 399/165 |

FOREIGN PATENT DOCUMENTS

| | | | |
|---|---|---|---|
| JP | 06-144631 | | 5/1994 |
| JP | 8-37565 | | 2/1996 |
| JP | 11-295948 | | 10/1999 |
| JP | 2000-122509 | | 4/2000 |
| JP | 2001083840 | A * | 3/2001 |
| JP | 2001-130779 | | 5/2001 |
| JP | 2005-74608 | | 3/2005 |
| JP | 2005074608 | A * | 3/2005 |
| JP | 2006-133472 | | 5/2006 |

* cited by examiner

*Primary Examiner* — David Gray
*Assistant Examiner* — Francis Gray
(74) *Attorney, Agent, or Firm* — Fildes & Outland, P.C.

(57) ABSTRACT

A belt rotating apparatus according to an exemplary embodiment of the invention includes a circular belt; plural rollers about which the belt is entrained, the plural rollers including a drive roller which rotates the belt and an inclination change roller which can change an inclination thereof; a belt side edge sensor which measures a position of a belt side edge in a belt width direction of the belt; and a cutter which can trim the belt side edge.

16 Claims, 14 Drawing Sheets

EDGE SENSOR MEASUREMENT DATA
(NO CONTROL)

EDGE SENSOR MEASUREMENT DATA
(NO WALK (MEANDERING))

EDGE SENSOR MEASUREMENT DATA
(AFTER EDGE CUT)

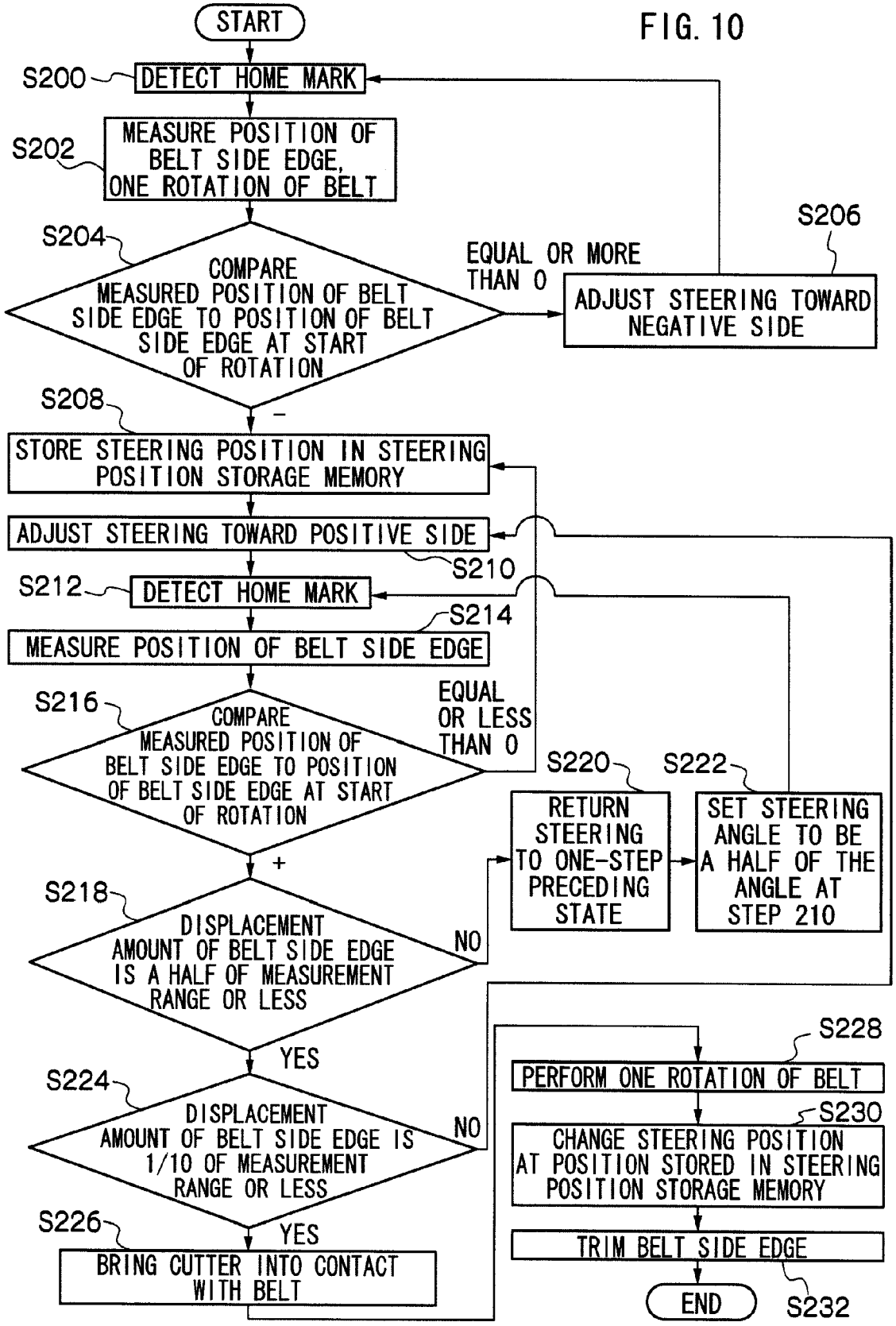
FIG. 10
START
S200
DETECT HOME MARK
S202
MEASURE POSITION OF BELT SIDE EDGE, ONE ROTATION OF BELT
S204
COMPARE MEASURED POSITION OF BELT SIDE EDGE TO POSITION OF BELT SIDE EDGE AT START OF ROTATION
EQUAL OR MORE THAN 0
S206
ADJUST STEERING TOWARD NEGATIVE SIDE
S208
STORE STEERING POSITION IN STEERING POSITION STORAGE MEMORY
ADJUST STEERING TOWARD POSITIVE SIDE
S210
S212
DETECT HOME MARK
S214
MEASURE POSITION OF BELT SIDE EDGE
S216
COMPARE MEASURED POSITION OF BELT SIDE EDGE TO POSITION OF BELT SIDE EDGE AT START OF ROTATION
EQUAL OR LESS THAN 0
S220
RETURN STEERING TO ONE-STEP PRECEDING STATE
S222
SET STEERING ANGLE TO BE A HALF OF THE ANGLE AT STEP 210
S218
DISPLACEMENT AMOUNT OF BELT SIDE EDGE IS A HALF OF MEASUREMENT RANGE OR LESS
NO
YES
S224
DISPLACEMENT AMOUNT OF BELT SIDE EDGE IS 1/10 OF MEASUREMENT RANGE OR LESS
NO
YES
S226
BRING CUTTER INTO CONTACT WITH BELT
S228
PERFORM ONE ROTATION OF BELT
S230
CHANGE STEERING POSITION AT POSITION STORED IN STEERING POSITION STORAGE MEMORY
TRIM BELT SIDE EDGE
END
S232

EDGE SENSOR MEASUREMENT DATA
(NO CONTROL)

EDGE SENSOR MEASUREMENT DATA
(SLIGHT WALK (MEANDERING))

BELT ROTATING APPARATUS AND RECORDING APPARATUS

CROSS-REFERENCE TO RELATED APPLICATIONS

This application is based on and claims priority under 35 USC 119 from Japanese Patent Application No. 2008-031151 filed on Feb. 12, 2008.

BACKGROUND OF THE INVENTION

Technical Field

The present invention relates to a belt rotating apparatus and a recording apparatus.

SUMMARY

In accordance with a first aspect of the invention, a belt rotating apparatus includes a circular belt; plural rollers about which the belt is entrained, the plural rollers including a drive roller which rotates the belt and an inclination change roller which is configured to change its own inclination; a belt side edge sensor which measures a position of a belt side edge in a belt width direction of the belt; and a cutter which is configured to trim the belt side edge.

BRIEF DESCRIPTION OF THE DRAWINGS

FIG. 10 is a flowchart showing a modification example of the procedure for trimming the belt side edge in the belt rotating apparatus of the exemplary embodiment;

DESCRIPTION

An exemplary embodiment of the invention will be described below with reference to the drawings.

(Entire Configuration of Recording Apparatus)

Figure 1:
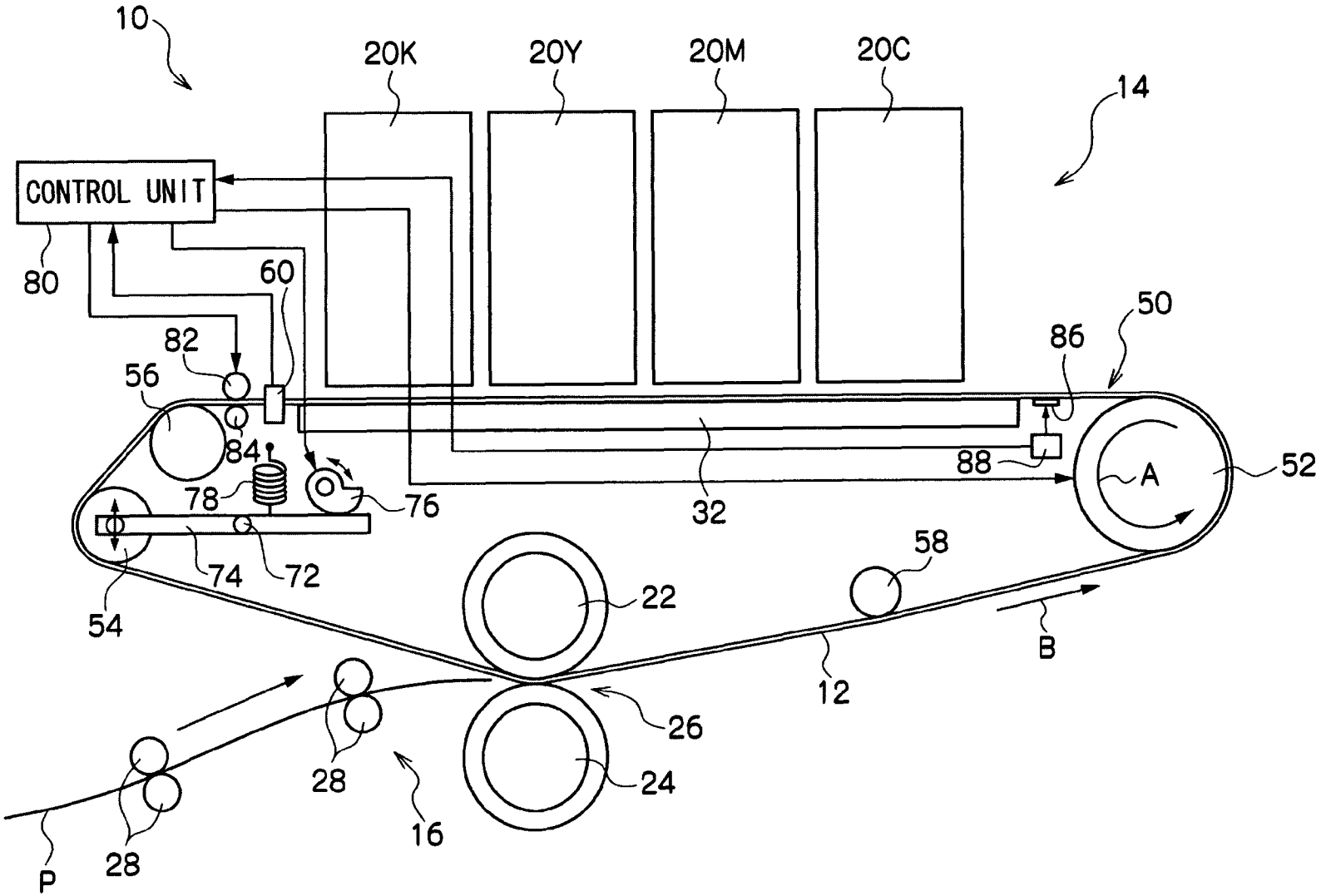
FIG. 1 is a schematic diagram showing an entire configuration of a recording apparatus according to an exemplary embodiment of the invention.

An entire configuration of a recording apparatus according to an exemplary embodiment of the invention will be described. FIG. 1 is a schematic diagram showing an entire configuration of a recording apparatus of the exemplary embodiment.

A recording apparatus 10 of the exemplary embodiment includes a recording medium storage unit (not shown) in which a recording medium P such as a sheet is accommodated, an image recording unit 14 which records an image in the recording medium P, a conveyance unit 16 which conveys the recording medium P from the recording medium storage unit to the image recording unit 14, and a recording medium discharge unit (not shown) to which the recording medium P on which the image is recorded by the image recording unit 14 is discharged.

The image recording unit 14 includes inkjet recording heads 20C, 20M, 20Y, and 20K (hereinafter referred to be 20C to 20K) which eject ink droplets to record the image and a transfer belt rotating apparatus 50 having a circular intermediate transfer belt 12.

The inkjet recording heads 20C to 20K are arranged in the color order of Cyan (C), Magenta (M), Yellow (Y), and Black (K) from an upstream side in a rotating direction of the intermediate transfer belt 12. In the inkjet recording heads 20C to 20K, the ink droplet corresponding to each color is ejected to an intermediate transfer belt 12 from plural nozzles formed in a nozzle surface by a piezoelectric system, and the image is formed on a surface of the intermediate transfer belt 12. In the inkjet recording heads 20C to 20K, another configuration in which the ink droplet is ejected by, for example, a thermal system may be adopted.

The inkjet recording heads 20C to 20K are formed such that a width direction (main-scanning directions of the inkjet recording heads 20C to 20K) is longer than the rotating direction (sub-scanning directions of the inkjet recording heads 20C to 20K) of the intermediate transfer belt 12. Each of the inkjet recording heads 20C to 20K may form one line in the main-scanning direction without being moved in the main-scanning direction relative to the intermediate transfer belt 12, and each of the inkjet recording heads 20C to 20K is moved in the sub-scanning direction relative to the intermediate transfer belt 12 to record a color image on the surface of the intermediate transfer belt 12. The width direction of the intermediate transfer belt 12 shall mean a direction intersecting a rotating direction of the intermediate transfer belt 12.

The intermediate transfer belt 12 conveys the color image recorded on the intermediate transfer belt 12 to a nip portion 26 formed between a transfer roller 22 and a facing roller 24 which faces the transfer roller 22.

Plural conveyance roller pairs 28 convey a recording medium P stored in the recording medium storage unit (not shown) to the nip portion 26. The transfer roller 22 transfers the color image conveyed by the intermediate transfer belt 12 to the recording medium P conveyed to the nip portion 26, thereby forming the color image on the recording medium P.

After the color image is fixed to the recording medium P, the recording medium P is discharged to the recording medium discharge unit (not shown).

In an inner periphery of the intermediate transfer belt 12, a flat plate 32 is provided to keep the intermediate transfer belt 12 smooth in an image recording area where the ink ejected from each of the inkjet recording heads 20C to 20K lands on the intermediate transfer belt 12.

(Configuration of Transfer Belt Rotating Apparatus 50)

A configuration of the transfer belt rotating apparatus 50 of the exemplary embodiment will be described below.

In the exemplary embodiment, the transfer belt rotating apparatus 50 having the intermediate transfer belt 12 is cited as an example of the belt rotating apparatus having the belt. However, the belt rotating apparatus having the belt is not limited to the transfer belt rotating apparatus.

The belt rotating apparatus may be a photosensitive belt rotating apparatus which rotates a photosensitive belt or a conveyance belt rotating apparatus which rotates a conveyance belt for conveying the recording medium.

The transfer belt rotating apparatus 50 of the exemplary embodiment is used in the inkjet recording apparatus. However, the belt rotating apparatus may be used in an electrophotographic recording apparatus. The belt rotating apparatus may be used in applications except for the recording apparatus which records the image.

As described above, the transfer belt rotating apparatus 50 includes the circular intermediate transfer belt 12. The intermediate transfer belt 12 is formed into an endless shape. The intermediate transfer belt 12 may be a belt having a seam in which end portions are joined to each other.

The intermediate transfer belt 12 is entrained about plural rollers (in the exemplary embodiment, five rollers) 22, 52, 54, 56, and 58. The plural rollers 22, 52, 54, 56, and 58 include the transfer roller 22, a drive roller 52 which rotates the intermediate transfer belt 12, a steering roller 54 which is of an example of the inclination change roller which may change the inclination thereof, a driven roller 56 which is driven by the intermediate transfer belt 12, and an adjustment roller 58 which may manually change the inclination.

It is only necessary to entrain the intermediate transfer belt 12 about at least two rollers. It is only necessary that the two rollers include at least the drive roller 52 and the steering roller 54. The steering roller 54 may also be used as the drive roller 52 or other rollers.

A drive unit imparts a drive force to the drive roller 52 to rotate the drive roller 52 in a predetermined direction (A direction in FIG. 1), and the drive roller 52 imparts a torque to the intermediate transfer belt 12 to rotate the intermediate transfer belt 12 in a predetermined direction (B direction in FIG. 1). The drive unit of the drive roller 52 is connected to a control unit 80, and the drive roller 52 is rotated based on a drive instruction by the control unit 80.

The transfer belt rotating apparatus 50 includes an edge sensor 60 which is of an example of the belt side edge sensor which measures a position of a belt side edge in the belt width direction of the intermediate transfer belt 12.

Figure 2:
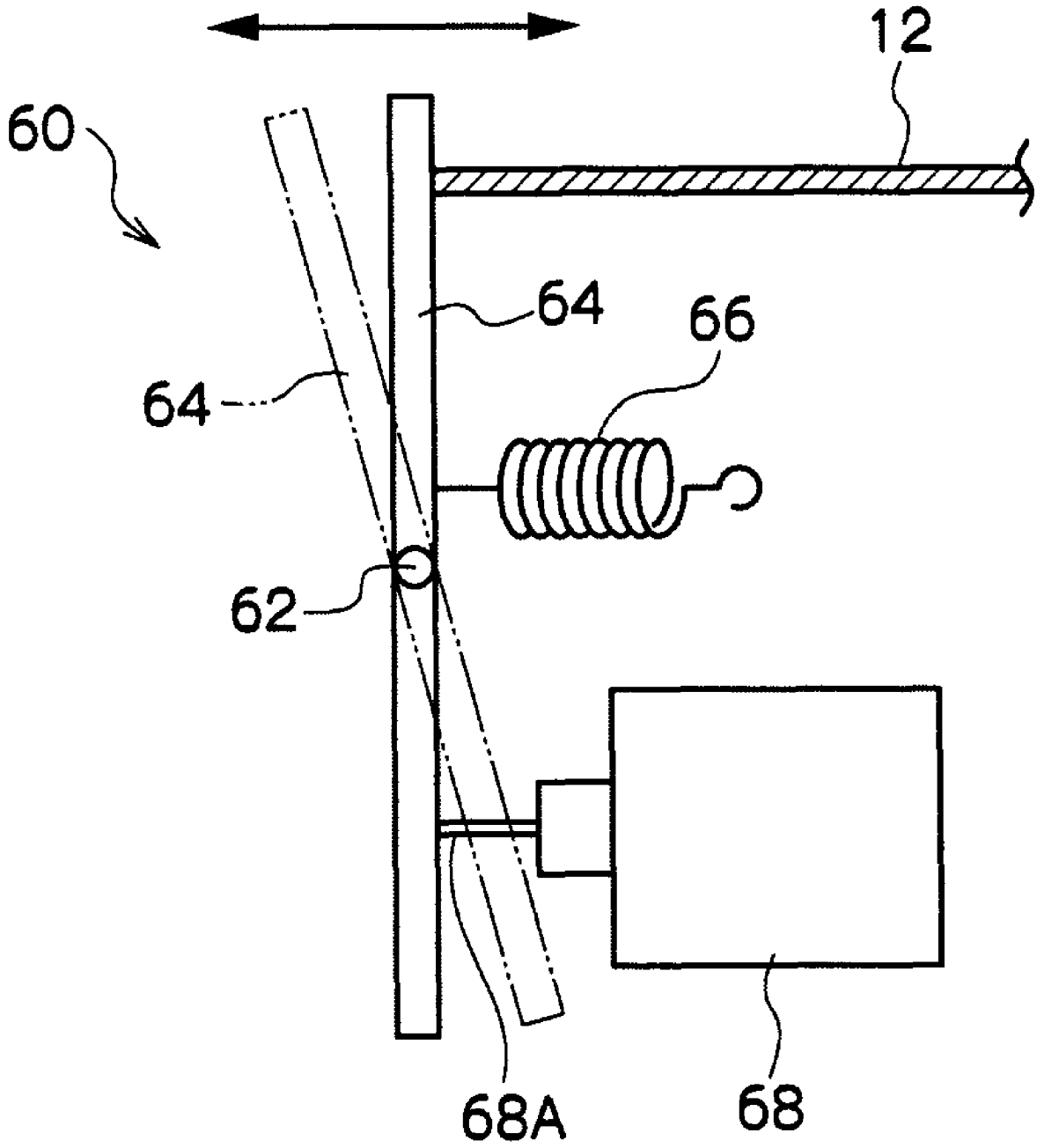
FIG. 2 is a schematic diagram showing a configuration of an edge sensor of the exemplary embodiment.

As shown in FIG. 2, the edge sensor 60 includes an arm 64 which is rotatable about a pivot 62 which is of the rotating axis, a tension spring 66 which is of an example of the biasing member, and a displacement sensor 68.

The tension spring 66 biases the arm 64 such that one of end portions of the arm 64 (upper-side portion of the arm 64 with respect to the pivot 62 in FIG. 2) is pulled toward the belt side edge of the intermediate transfer belt 12. Therefore, the arm 64 is maintained while one of the end portions abuts on the belt side edge of the intermediate transfer belt 12.

When the intermediate transfer belt 12 is moved in the width direction thereof, the one of the end portions of the arm 64 which abuts on the belt side edge of the intermediate transfer belt 12 is rotated about the pivot 62, which displaces the other end portion (lower-side portion of the arm 64 with respect to the pivot 62 in FIG. 2) of the arm 64.

A measuring portion 68A of the displacement sensor 68 abuts on the other end portion of the arm 64, and the measuring portion 68A measures a displacement amount of the other end portion of the arm 64. Therefore, a movement amount of the belt side edge of the intermediate transfer belt 12 is measured, and the belt side edge position is measured in the belt width direction.

Figure 4A:
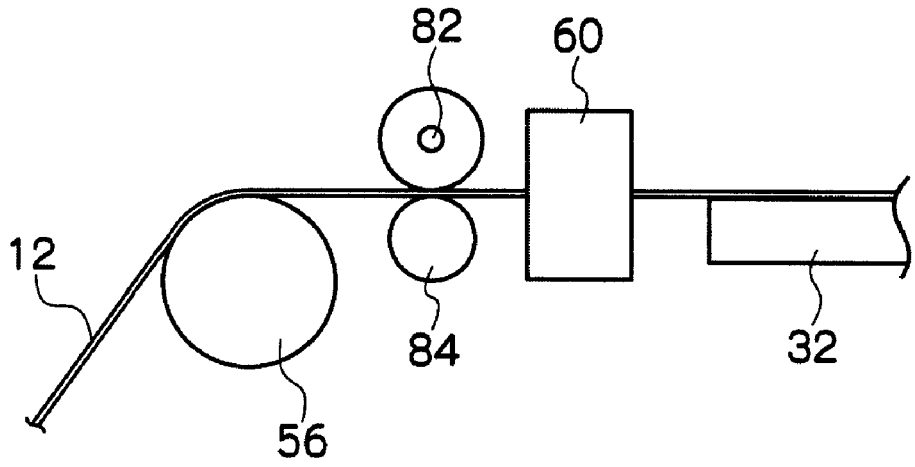
FIGS. 4A and 4B are schematic diagrams showing a configuration of a belt edge cutter of the embodiment.
Figure 4B:
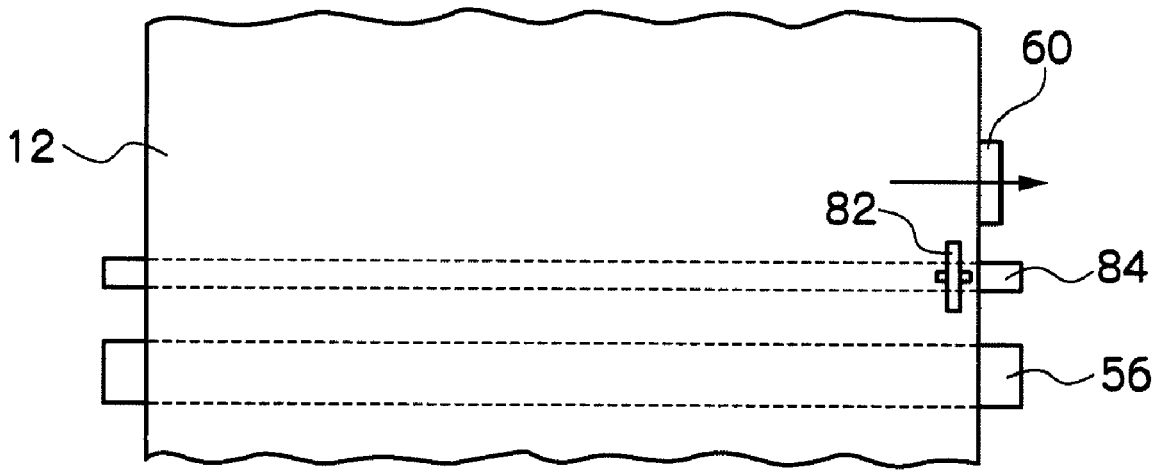

In the neighborhood of the belt side edge of the intermediate transfer belt 12, the outside shall mean an outside in the belt width direction and the outside is indicated by an arrow direction of FIG. 4B, and the inside shall mean an inside in the belt width direction and the inside is indicated by the opposite direction to the arrow direction of FIG. 4B.

As shown in FIG. 1, the edge sensor 60 is connected to the control unit 80, and positional information on the belt side edge in the belt width direction is transmitted to the control unit 80. The edge sensor 60 supplies a positive value to the control unit 80 when the intermediate transfer belt 12 is moved outer side in the belt width direction, and the edge sensor 60 supplies a negative value to the control unit 80 when the intermediate transfer belt 12 is moved inner side in the belt width direction.

The edge sensor 60 is not limited to the contact type sensor, but the edge sensor 60 may be a non-contact type sensor in which a laser beam is utilized.

Figure 3:
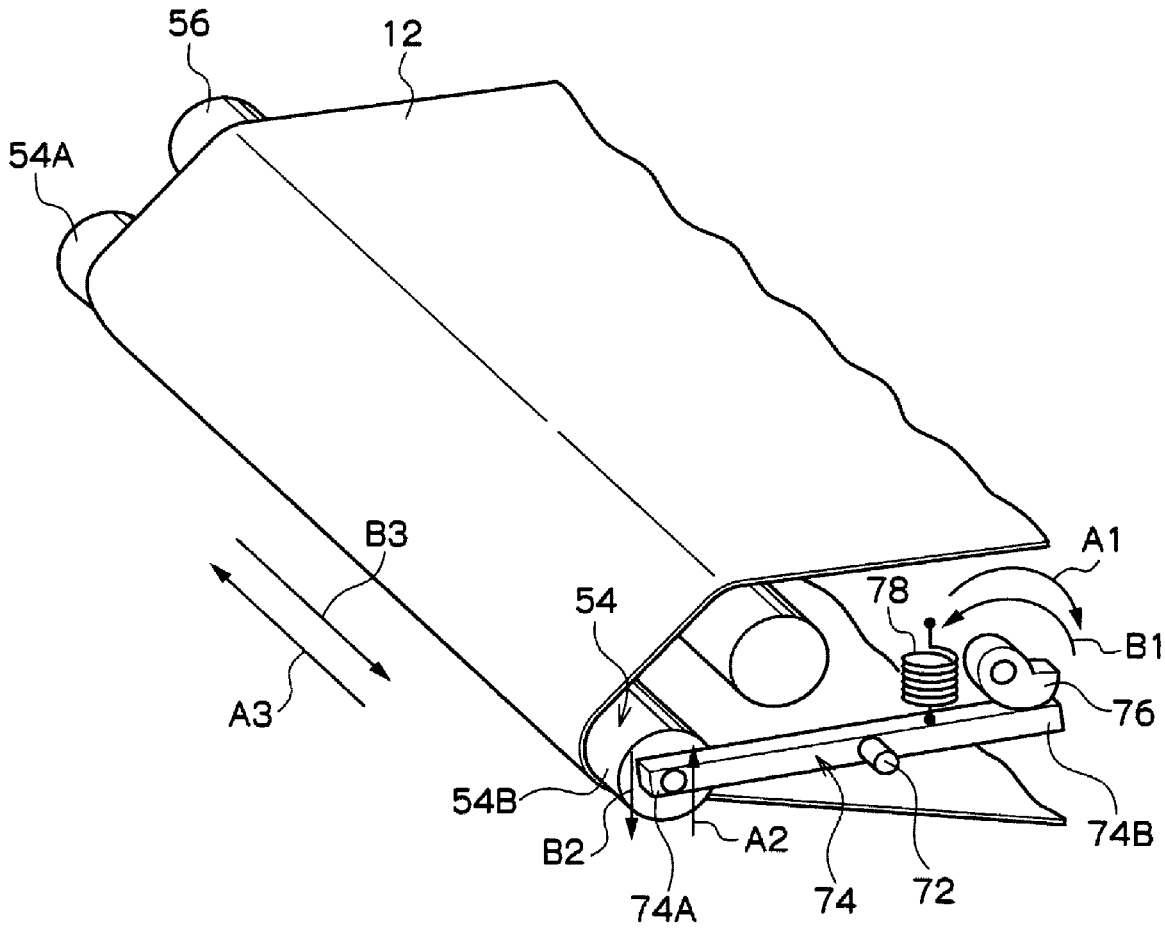
FIG. 3 is a perspective view showing a configuration in which an inclination of a steering roller of the exemplary embodiment is changed.

In the steering roller 54, as shown in FIGS. 1 and 3, while a position of a first end portion 54A in the axial direction is fixed, a second end portion 54B in the axial direction of the steering roller 54 is fixed to a first end portion 74A of an arm 74 which is rotatable about a rotating axis 72, and the second end portion 54B may be swung about the rotating axis 72.

A cam 76 and a tension spring 78 are provided in a second end portion 74B of the arm 74. The cam 76 is rotatably supported, and the tension spring 78 is of the biasing member which biases the second end portion 74B of the arm 74 against the cam 76.

The tension spring 78 pulls the second end portion 74B of the arm 74 upward. Therefore, the second end portion 74B of the arm 74 is kept abutted on the cam 76.

In the cam 76, a circumferential surface whose distance from a rotating axis is not kept constant abuts on the second end portion 74B of the arm 74. A drive unit of the cam 76 is connected to the control unit 80, and the cam 76 is rotated to displace the second end portion 74B of the arm 74 based on a drive instruction of the control unit 80. The displacement of the second end portion 74B of the arm 74 displaces the first end portion 74A of the arm 74 to change the inclination of the steering roller 54. The change of the inclination of the steering roller 54 moves the intermediate transfer belt 12 along the steering roller 54.

Specifically, the edge sensor 60 transmits the positional information on the belt side edge in the belt width direction, the control unit 80 computes a correction amount of meandering of the intermediate transfer belt 12 based on the positional information, and the control unit 80 performs a predetermined amount of rotation to the cam 76 in a direction A1 or B1 of FIG. 3 according to the correction amount.

When the cam 76 is rotated in the direction A1 of FIG. 3 to press down the second end portion 74B of the arm 74, the second end portion 54B of the steering roller 54 is lifted in a direction A2 of FIG. 3 through the first end portion 74A of the arm 74, and the intermediate transfer belt 12 is moved in a direction A3 of FIG. 3.

On the other hand, when the cam 76 is rotated in the direction B1 of FIG. 3 to cause the tension spring 78 to lift the second end portion 74B of the arm 74, the second end portion 54B of the steering roller 54 is pressed down in a direction B2 of FIG. 3 through the first end portion 74A of the arm 74, and the intermediate transfer belt 12 is moved in a direction B3 of FIG. 3.

As shown in FIGS. 1 and 4, the transfer belt rotating apparatus 50 includes a belt edge cutter 82 which may trim the belt side edge. As shown in FIG. 4, the belt edge cutter 82 is a circle cutter, and a facing roller 84 which becomes a pad is disposed to face the belt edge cutter 82 while the intermediate transfer belt 12 is provided between the belt edge cutter 82 and the facing roller 84. The facing roller 84 is driven by the intermediate transfer belt 12.

The belt edge cutter 82 is disposed on the side on which the edge sensor 60 is provided, and the belt edge cutter 82 trims the belt side edge measured by the edge sensor 60.

The belt edge cutter 82 may be brought into contact with and separated from the intermediate transfer belt 12. A drive unit of the belt edge cutter 82 is connected to the control unit 80, the belt edge cutter 82 is brought into contact with the intermediate transfer belt 12 based on a contact instruction of the control unit 80, and the belt edge cutter 82 is separated from the intermediate transfer belt 12 based on a separation instruction of the control unit 80.

The control unit 80 drives the drive roller 52 to rotate the intermediate transfer belt 12 while bringing the belt edge cutter 82 into contact with the intermediate transfer belt 12, thereby trimming the belt side edge of the intermediate transfer belt 12.

The belt edge cutter 82 is disposed inner side the belt side edge rather than an envisioned displacement amount of the belt side edge so as not to be located on the outer side of the belt side edge in the belt width direction even if the belt side edge is displaced at the envisioned amount.

From the viewpoint of cutting edge protection of the belt edge cutter 82, preferably an elastic material such as rubber and a resin is used as a material for the surface of the facing roller 84. The facing roller 84 may not be driven by the intermediate transfer belt 12, but the facing roller 84 may be a facing platen which is slid on and brought into contact with the intermediate transfer belt 12. In the case of the facing platen, desirably the elastic material such as the rubber and the resin is also used as the material for the surface.

In order to reduce a sliding load on the belt, preferably the facing roller 84 and the facing platen are brought into contact with the intermediate transfer belt 12 when the belt side edge is trimmed, and the facing roller 84 and the facing platen are separated from the intermediate transfer belt 12 in other cases.

The belt edge cutter 82 and the facing roller 84 may be formed into an integral unit, or the belt edge cutter 82 and the facing roller 84 may separately be formed. Alternatively, the belt edge cutter 82 and the facing roller 84 may be detachably attached to the transfer belt rotating apparatus 50 and, in a case that the trimming of the belt side edge is necessary, for example, the intermediate transfer belt 12 is replaced for new one, an operator attaches the belt edge cutter 82 and the facing roller 84 to perform the work for trimming the belt side edge, and the belt edge cutter 82 and the facing roller 84 may be detached after the work is completed.

The belt edge cutter 82 is not limited to a circle cutter, but the belt edge cutter 82 may be a usual knife cutter, laser cutter, and ultrasonic cutter.

Figure 5:
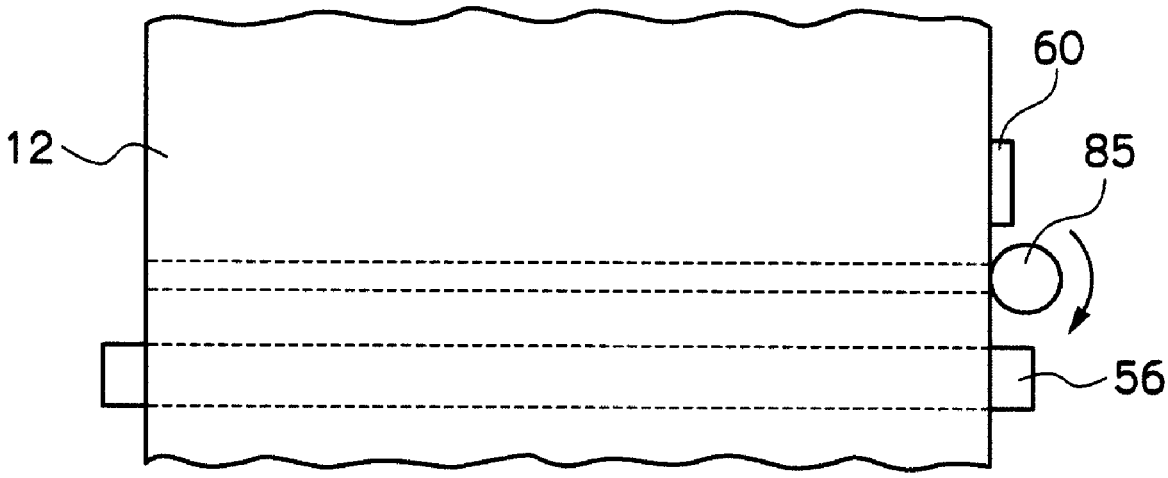
FIG. 5 is a schematic diagram showing a configuration of a modification of the belt edge cutter of the exemplary embodiment.

As shown in FIG. 5, a rotating file 85 may be used instead of the belt edge cutter 82. The rotating file 85 removes a part of the belt side edge by filing away the belt side edge.

In the exemplary embodiment, as shown in FIG. 1, a home mark 86 for detecting a home position of the intermediate transfer belt 12 is provided at an inner circumferential surface of the intermediate transfer belt 12, and the transfer belt rotating apparatus 50 includes a sensor 88 which detects the home mark 86. The sensor 88 detects the home mark 86 every one rotation of the intermediate transfer belt 12, thereby detecting timing of one rotation of the intermediate transfer belt 12. The sensor 88 is connected to the control unit 80, and detection information on the detected home mark 86 is transmitted to the control unit 80.

(Procedure for Trimming Belt Side Edge of Intermediate Transfer Belt 12)

Figure 6:
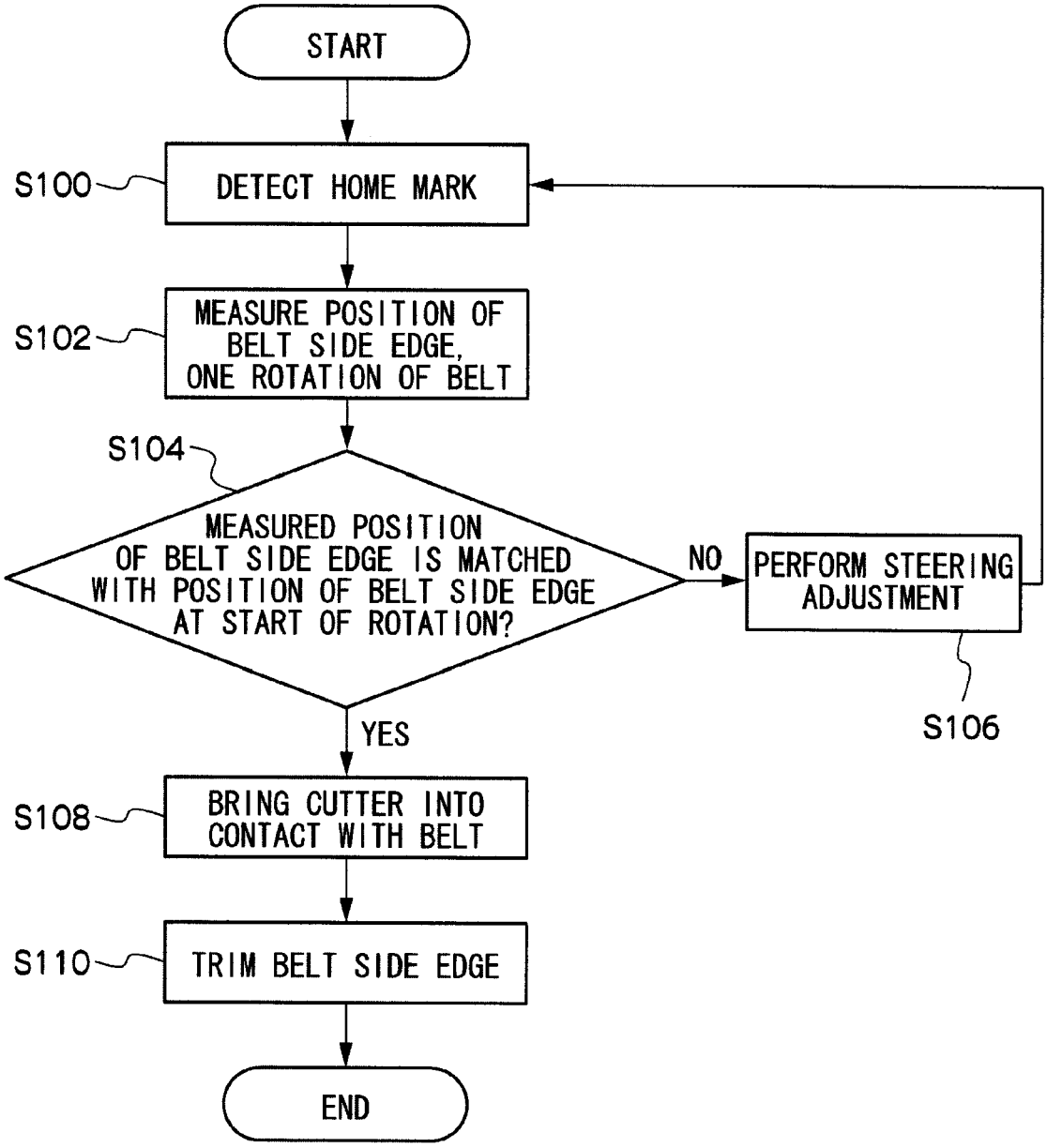
FIG. 6 is a flowchart showing a procedure for trimming a belt side edge in a belt rotating apparatus of the exemplary embodiment.

A procedure for trimming the belt side edge of the intermediate transfer belt 12 will be described with reference to a flowchart of FIG. 6.

In Step 100, the sensor 88 detects the home mark 86 provided at the rotating intermediate transfer belt 12 when the transfer belt rotating apparatus 50 starts the operation of trimming the belt side edge. The detection information in which the sensor 88 detects the home mark 86 is transmitted to the control unit 80.

In Step 102, based on the instruction of the control unit 80, the edge sensor 60 starts the measurement of the belt side edge in the belt width direction of the intermediate transfer belt 12. The positional information on the belt side edge measured by the edge sensor 60 is transmitted to the control unit 80.

The sensor 88 detects the home mark 86 provided at the rotating intermediate transfer belt 12 again, and the detection information is transmitted to the control unit 80, whereby the control unit 80 detects the one rotation of the intermediate transfer belt 12.

Figure 8A:
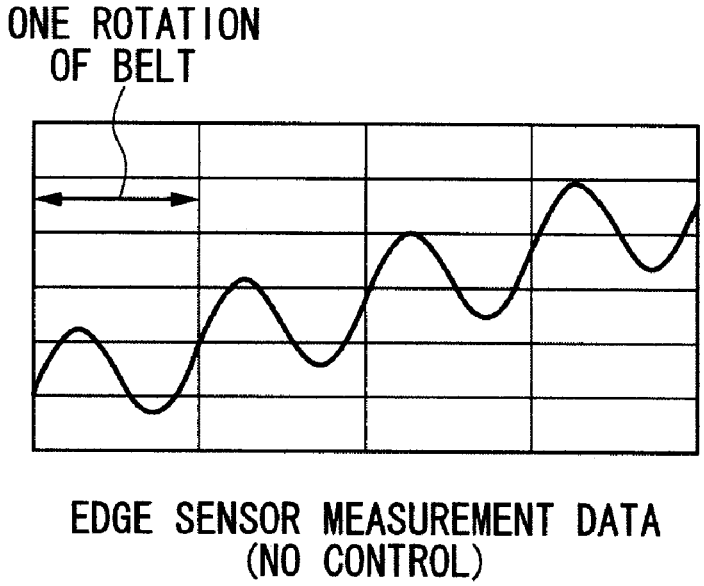
FIGS. 8A, 8B, and 8C show measurement information on the edge sensor of the exemplary embodiment.

At this point, in the information measured by the edge sensor 60, as shown in FIG. 8A, the belt side edge position is displaced in a waveform manner, and the belt side edge position is displaced toward one direction as the number of belt rotations is increased.

The reason why the belt side edge position is displaced toward one direction as the number of rotations is increased while the belt side edge position is displaced in the waveform manner in the measurement information is attributed to the fact that both sets of measurement information (see FIGS. 8B and 8C) overlap each other to indicate the information shown in FIG. 8A. Information shown in FIG. 8B indicates a walk component (meandering component) of the intermediate transfer belt 12 caused by the position shift or inclination of each of the rollers 22, 52, 54, 56, and 58 about which the intermediate transfer belt 12 is entrained. Information shown in FIG. 8C indicates a profile component of the belt side edge caused by a shape variation of the intermediate transfer belt 12. FIG. 9 shows plural examples of the shape variation of the intermediate transfer belt 12, and a portion indicated by dotted lines in FIG. 9 shows the shape-variation-free belt shape.

Figure 8B:
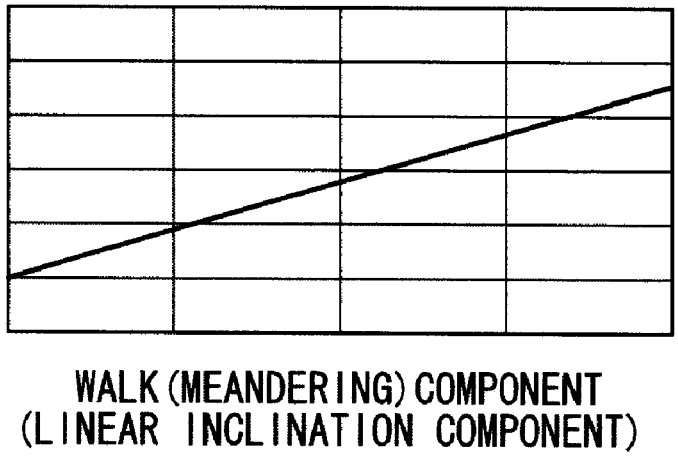
Figure 8C:
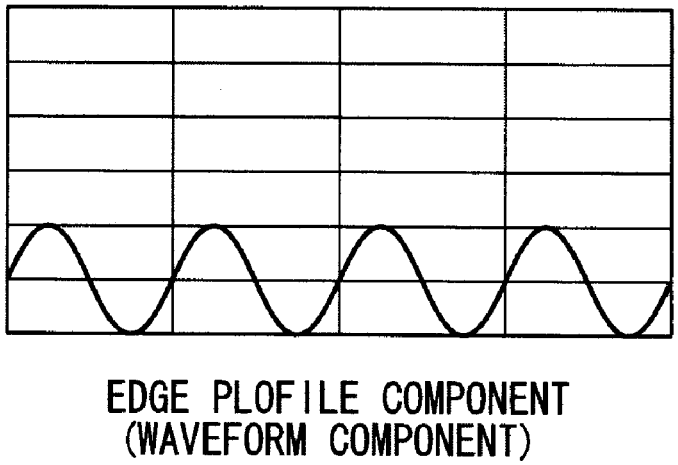
Figure 9:
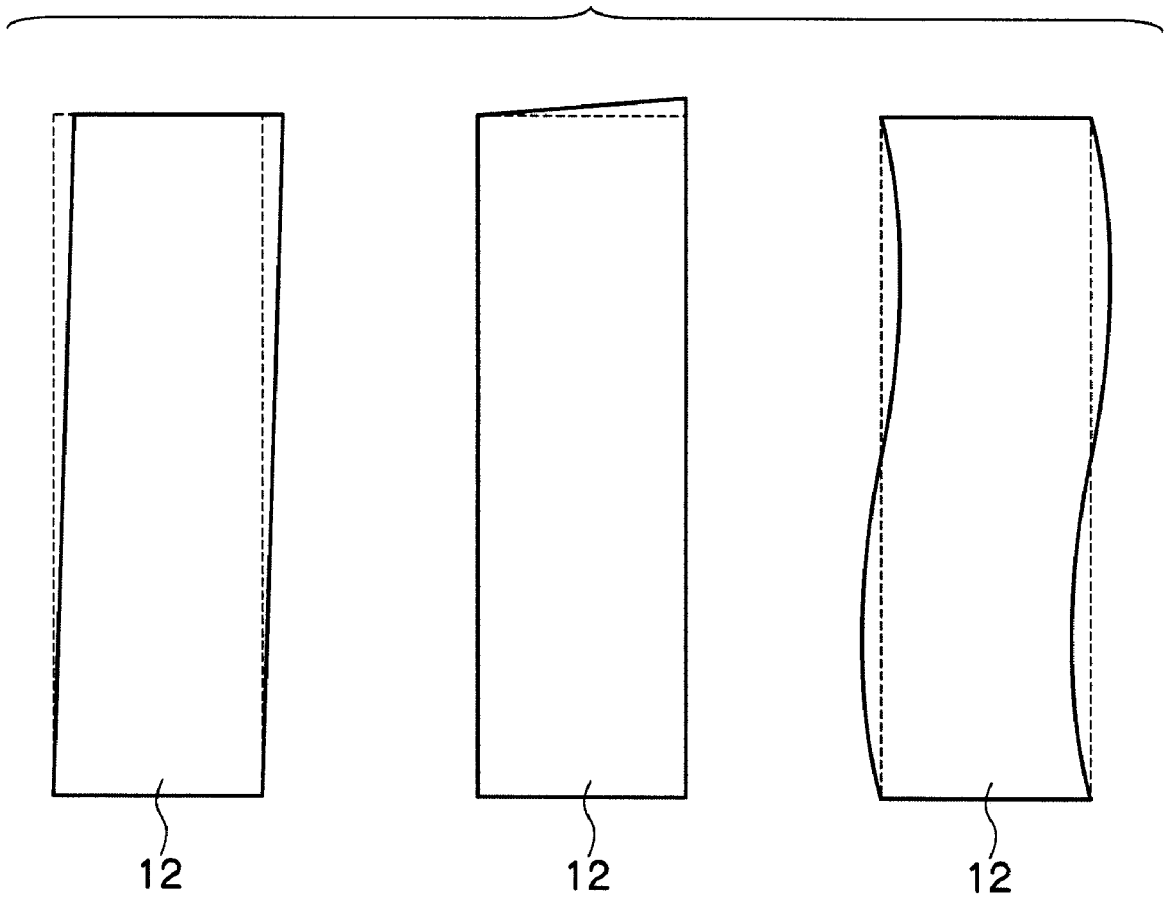
FIG. 9 is a schematic diagram showing plural examples of a shape error of an intermediate transfer belt of the exemplary embodiment.

As shown in FIG. 8B, the information indicating the walk component becomes the linear inclination component which indicates that the belt side edge of the intermediate transfer belt 12 is displaced toward one direction in the belt width direction. As shown in FIG. 8C, the information indicating the profile component of the belt side edge becomes the waveform component which indicates that the belt side edge of the intermediate transfer belt 12 is periodically displaced in both directions in the belt width direction.

The items of measurement information of FIGS. 7A through 8C indicate a transition of the position in the belt width direction of the belt side edge according to the rotation of the intermediate transfer belt 12, and a vertical axis relatively indicates the belt side edge position in the belt width direction of the intermediate transfer belt 12.

In Step 104, the control unit 80 determines whether or not the belt side edge position (measured value of edge sensor 60) is matched with that of the belt side edge at the start when one rotation of the intermediate transfer belt 12 is completed. The timing at which the edge sensor 60 detects the belt side edge position may be identical to the timing at which the sensor 88 detects the home mark 86, or the edge sensor 60 may detect the belt side edge position at the timing at which the belt is conveyed to a predetermined distance after the home mark 86 is detected.

When the belt side edge position is not matched with that of the belt side edge at the start time, the process goes to Step 106, and the control unit 80 controls the inclination of the steering roller 54 such that the belt side edge position is matched with that of the belt side edge at the start time. As shown in FIG. 7B, the position of the steering roller 54 where the walk (meandering) of the intermediate transfer belt 12 becomes zero is obtained, and the inclination of the steering roller 54 is aligned with the obtained position. After the inclination of the steering roller 54 is controlled in Step 106, the process returns to Step 100. The steering adjustment in Steps 100, 102, 104, and 106 are performed once or repeatedly performed until the belt side edge position is matched with that of the belt side edge at the start time.

Figure 7A:
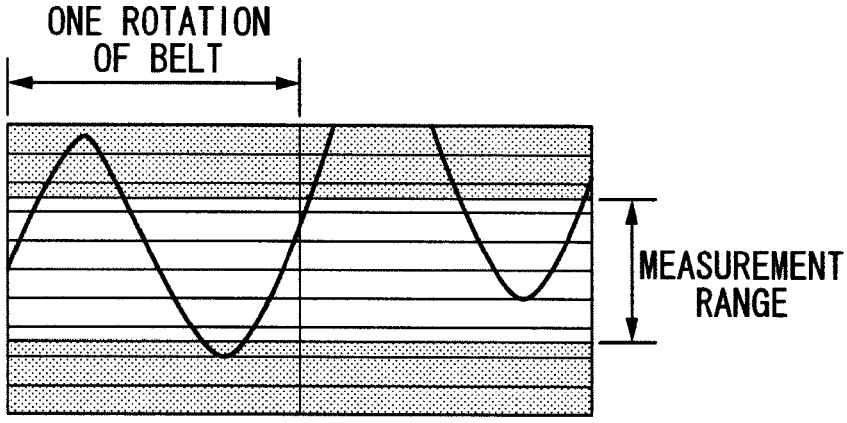
FIGS. 7A, 7B, and 7C show measurement information on the edge sensor of the exemplary embodiment.
Figure 7B:
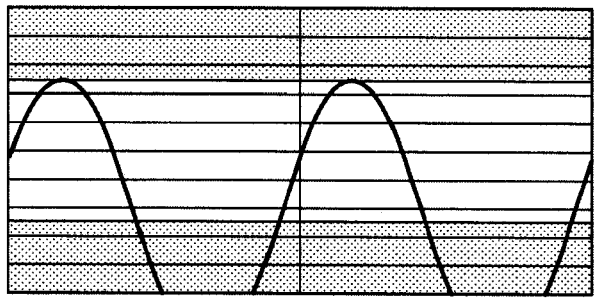

Noted that, in the example of FIG. 7A, because the belt side edge is not matched with that of the belt side edge at the start time, the process goes to Step 106. When the belt is long, a meandering width is increased and sometimes the belt side edge position is partially out of a measurement range (measurable range) of the edge sensor 60 as shown in FIG. 7A. However, it is only necessary that the belt side edge position fall within the measurement range at the start timing and the timing after one rotation, and no trouble occurs even if the belt side edge position exceeds the measurement range in midcourse.

The invention is not limited to the configuration in which the control unit 80 controls the steering roller 54 to automatically control the meandering of the intermediate transfer belt 12, but the operator may manually change the inclination of the adjustment roller 58 to adjust the meandering of the intermediate transfer belt 12 based on the measurement result of the edge sensor 60.

On the other hand, when the belt side edge position is matched with that of the belt side edge at the start time in Step 104, the process goes to Step 108, the belt edge cutter 82 is brought into contact with the intermediate transfer belt 12 based on the contact instruction of the control unit 80.

In Step 110, one turn of the intermediate transfer belt 12 is performed to trim the belt side edge of the intermediate transfer belt 12 along the rotating direction of the intermediate transfer belt 12, and the trimmed belt side edge is removed to end the operation of trimming the belt side edge.

In the exemplary embodiment, the control unit 80 controls the belt edge cutter 82 and the cutter is automatically brought into contact with the intermediate transfer belt 12 to trim the belt side edge thereof. The cutter is not manually manipulated. The operator may manually manipulate the belt edge cutter 82, instead.

Figure 7C:
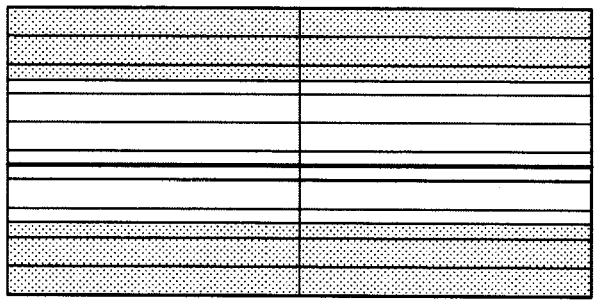

As described above, the belt side edge is trimmed without generating a step in the belt side edge, the shape variation of the belt side edge is eliminated, and the profile component of the belt side edge substantially becomes zero. By this, in the information measured by the edge sensor 60, both the walk component and the profile component become zero as shown in FIG. 7C. At this point, the belt side edge position of the intermediate transfer belt 12 does not exceed the measurement range of the edge sensor 60.

(Alternative Example of Procedure for Trimming Belt Side Edge of Intermediate Transfer Belt 12)

An alternative example of the procedure for trimming the belt side edge of the intermediate transfer belt 12 will be described below with reference to the flowchart of FIG. 10.

In Step 200, the sensor 88 detects the home mark 86 provided at the rotating intermediate transfer belt 12 when the transfer belt rotating apparatus 50 starts the operation of trimming the belt side edge. Detection information to the effect that the sensor 88 has detected the home mark 86 is transmitted to the control unit 80.

In Step 202, based on the instruction of the control unit 80, the edge sensor 60 starts the measurement of the belt side edge in the belt width direction of the intermediate transfer belt 12. The positional information on the belt side edge measured by the edge sensor 60 is transmitted to the control unit 80.

The sensor 88 detects the home mark 86 provided at the rotating intermediate transfer belt 12 again, and the detection information is transmitted to the control unit 80, whereby the control unit 80 detects one rotation of the intermediate transfer belt 12.

Figure 12A:
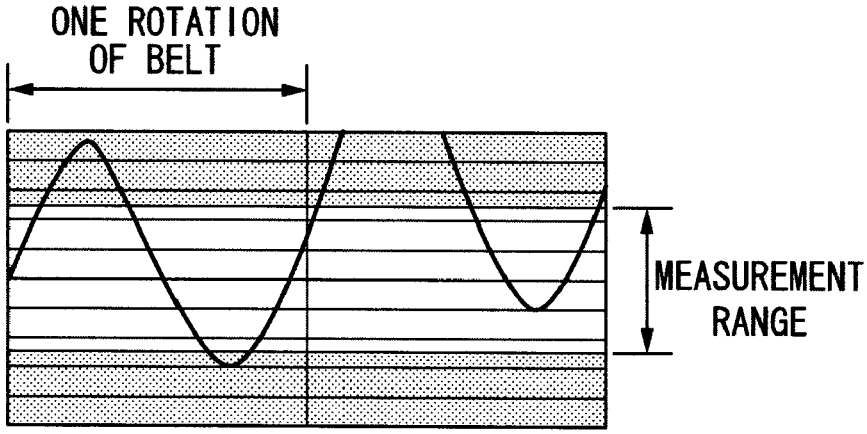
FIGS. 12A and 12B show measurement information on the edge sensor of the exemplary embodiment.

At this point, in the information measured by the edge sensor 60, as shown in FIG. 12A, the belt side edge position is displaced in the waveform manner, and the belt side edge position is displaced toward one direction as the number of turns is increased.

Figure 12B:
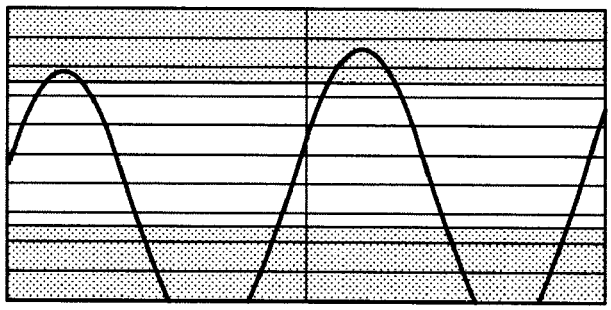

The items of measurement information of FIGS. 12A and 12B indicate a transition of the position in the belt width direction of the belt side edge according to the rotation of the intermediate transfer belt 12, and the vertical axis relatively indicates the belt side edge position in the belt width direction of the intermediate transfer belt 12.

In Step 204, the control unit 80 compares the position (measured value of the edge sensor 60) of the belt side edge after one rotation of the intermediate transfer belt 12 to the position (measured value of the edge sensor 60) of the belt side edge at the start time.

As a result of the comparison in Step 204, when the belt side edge position after one rotation of the intermediate transfer belt 12 is located at the same position (measured value of the edge sensor 60 is zero) as the belt side edge at the start time, or when the belt side edge position after one rotation of the intermediate transfer belt 12 is located at the outer side (positive side of the measured value of the edge sensor 60) of the belt side edge position at the start time in the belt width direction, the process goes to Step 206, and the control unit 80 controls the inclination of the steering roller 54 such that the belt side edge position is located at the inner side (negative side of the measured value of the edge sensor 60) of the belt side edge position in the belt width direction at the start time. Then the process returns to Step 200. The steering adjustments in Steps 200, 202, 204, and 206 are performed or repeatedly performed until the belt side edge position is located at the inner side (negative side of the measured value of the edge sensor 60) of the belt side edge in the belt width direction at the start time.

As a result of the comparison in Step 204, when the belt side edge position after one rotation of the intermediate transfer belt 12 is located at the inner side (negative side of the measured value of the edge sensor 60) of the belt side edge position in the belt width direction at the start time, the process goes to Step 208, and the control unit 80 stores a steering position of the steering roller 54, that is, a steering angle at which the steering roller 54 was inclined, in the steering position storage memory. Then the process goes to Step 210.

In Step 210, the control unit 80 controls the inclination of the steering roller 54 such that the belt side edge position which was previously set at the inner side of the belt side edge position in the belt width direction at the start time in the preceding Steps is located slightly at the outer side of the belt side edge position at the start time. That is, as shown in FIG. 12B, the position (steering angle at which the steering roller 54 is inclined) of the steering roller 54 at which the walk (meandering) of the intermediate transfer belt 12 becomes positive (the belt side edge of the intermediate transfer belt 12 is displaced toward the outer side in the width direction according to the rotation) is found and the steering roller 54 is inclined accordingly. Then the process goes to Step 212.

In Step 212, the sensor 88 detects the home mark 86 provided at the rotating intermediate transfer belt 12. The detection information to the effect that the sensor 88 has detected the home mark 86 is transmitted to the control unit 80.

In Step 214, based on the instruction of the control unit 80, the edge sensor 60 starts the measurement of the belt side edge in the belt width direction of the intermediate transfer belt 12. The positional information on the belt side edge position in the belt width direction measured by the edge sensor 60 is transmitted to the control unit 80.

The sensor 88 again detects the home mark 86 provided at the rotating intermediate transfer belt 12, and the detection information is transmitted to the control unit 80, whereby the control unit 80 detects one rotation of the intermediate transfer belt 12.

In Step 216, the control unit 80 compares the position (measured value of the edge sensor 60) of the belt side edge after one rotation of the intermediate transfer belt 12 to the position (measured value of the edge sensor 60) of the belt side edge at the start time of the one rotation.

As a result of the comparison in Step 216, when the belt side edge position is located at the same position (measured value of the edge sensor 60 is zero) as the belt side edge at the start time of the one rotation, or when the belt side edge position is located at the inner side (negative side of the measured value of the edge sensor 60) of the belt side edge position at the start time of the one rotation, the process returns to Step 208.

As a result of the comparison in Step 216, when the belt side edge position after one rotation of the intermediate transfer belt 12 is located at the outer side (positive side of the measured value of the edge sensor 60) of the belt side edge position at the start time of the one rotation, the process goes to Step 218.

In Step 218, the control unit 80 determines whether or not the displacement amount of the belt side edge in the belt width direction from the belt side edge position at the start time of the one rotation is a half or less of the measurement range of the edge sensor 60.

As a result of the comparison in Step 218, when the displacement amount is greater than a half or less of the measurement range of the edge sensor 60, the process goes to Step 220, and the inclination of the steering roller 54 is returned to the state of one step before. That is, the inclination of the steering roller 54 is adjusted such that the adjustment amount performed in the immediately preceding Step 210 is canceled, and the inclination of the steering roller 54 is returned to the state in Step 208. Then the process goes to Step 222.

In Step 222, the inclination of the steering roller 54 is adjusted by a half of the adjustment amount of the steering roller 54 which was performed in Step 210 such that the belt side edge position is located at the outer side of the belt side edge position at the start time of the rotation. This is referred to as "halving the steering angle of the steering roller 54". Then the process returns to Step 212.

As a result of the comparison in Step 218, when the displacement amount is a half or less of the measurement range of the edge sensor 60, the process goes to Step 224.

In Step 224, the control unit 80 determines whether or not the displacement amount of the belt side edge in the belt width direction from the belt side edge position at the start time of the one rotation is 1/10 of the measurement range of the edge sensor 60 or more.

As a result of the comparison in Step 224, when the displacement amount is less than 1/10 of the measurement range of the edge sensor 60, the process returns to Step 210. As a result of the comparison in Step 224, when the displacement amount is 1/10 of the measurement range of the edge sensor 60 or more, the process goes to Step 226.

In Step 226, the belt edge cutter 82 is brought into contact with the intermediate transfer belt 12 based on a contact instruction from the control unit 80. In Step 228, one rotation of the intermediate transfer belt 12 is performed.

In Step 230, the inclination of the steering roller 54 is changed to the steering position stored in the steering position storage memory in Step 208 such that the belt side edge position after one rotation of the intermediate transfer belt 12 is slightly moved to an inner side in the belt width direction (the negative side of the measured value of the edge sensor 60).

In Step 232, the intermediate transfer belt 12 is rotated to trim the belt side edge of the intermediate transfer belt 12 along the rotating direction thereof. FIG. 11B shows this state. The trimmed belt side edge is removed to end the operation of trimming the belt side edge.

In this manner, the control unit 80 controls the belt edge cutter 82, and the cutter is automatically brought into contact with the intermediate transfer belt 12 to trim the belt side edge of the intermediate transfer belt 12. The operator may manually manipulate the belt edge cutter 82.

In order that the belt is trimmed such that the smooth belt side edge is obtained with no step in the obtained belt side edge, it is necessary that the belt side edge be moved outer side (positive direction) once to perform the trimming. In the belt steering control during the actual image recording after the trimming of the belt, preferably the profile component indicating the belt shape variation is decreased as much as possible from the viewpoint of belt position accuracy. Therefore, in the adjustment amount in Step 210, the belt side edge is adjusted so as to be located outer side in the belt width direction within the range of 1/10 to 1/2 of the measurement range of the edge sensor 60. Because the walk component indicating the belt meandering is overlapped on the measured value in the actual control, the belt movement amount to the outer side is decreased as much as possible and, for example, it is necessary that the belt movement amount to the outer side be restricted to 1/2 or less of the measurement range. On the other hand, when the belt movement amount to the outer side is excessively small, the belt side edge may be cut inner side against the operator's intention due to unexpected disturbance such as impact or a belt conveyance variation. For this reason, it is more practicable to set the belt movement amount to the outer side at a predetermined value or more. For example, the belt movement amount to the outer side is set 1/10 or more of the measurement range.

When the belt is long, the meandering width is increased accordingly, and the belt side edge position is out of the measurement range of the edge sensor 60 as shown in FIG. 12A. However, it is only necessary that the belt side edge position fall within the measurement range at the start timing and the timing after one rotation, and no trouble occurs even if the belt side edge position exceeds the measurement range in mid-course.

The invention is not limited to the configuration in which the control unit 80 controls the steering roller 54 to automatically control the meandering of the intermediate transfer belt 12, but the operator may manually change the inclination of the adjustment roller 58 to adjust the meandering of the intermediate transfer belt 12 based on the measurement result of the edge sensor 60.

Figure 11A:
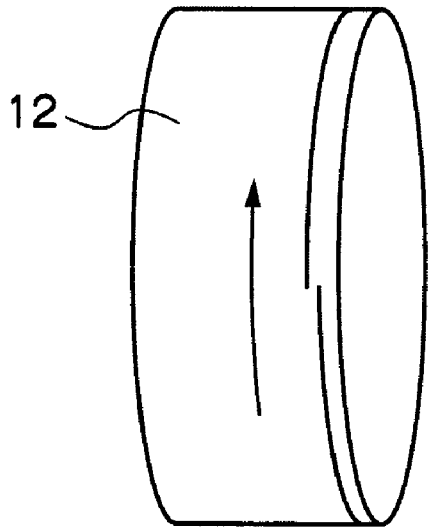
FIGS. 11A and 11B are schematic diagrams showing a state in which the belt side edge is trimmed in the modification example of the procedure for trimming the belt side edge.
Figure 11B:
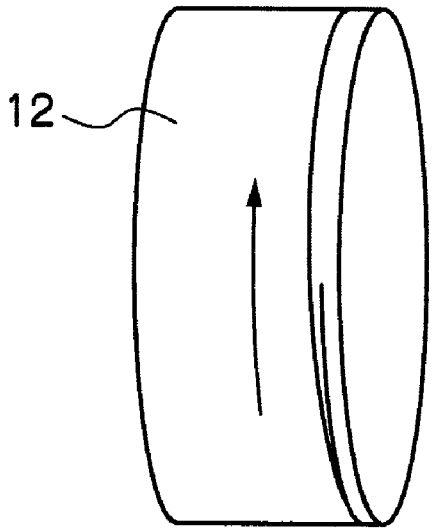

FIG. 11A shows the state in which the belt edge is located outer side in the width direction compared with the start point of the rotation when one rotation of the intermediate transfer belt 12 is performed. The line drawn inner side the intermediate transfer belt 12 indicates the cut line of the belt edge cutter 82 when the intermediate transfer belt 12 is rotated. FIG. 11B shows the state in which the inclination of the steering roller 54 is changed to rotate belt such that the belt edge is located inner side in the width direction compared with the start point of the rotation after one rotation of the intermediate transfer belt 12 is performed. The line drawn inner side the intermediate transfer belt 12 indicates the cut line of the belt edge cutter 82, and the cut line after one rotation of the intermediate transfer belt 12 merges the cut line at the start point of the rotation.

In the exemplary embodiment, the inclination of the steering roller 54 is changed such that the belt side edge position is slightly moved inner side (measured value of the edge sensor 60 becomes the negative side) after one rotation of the intermediate transfer belt 12. However, as long as the belt may be trimmed such that the step is not generated in the cut line, the inclination of the steering roller 54 may be changed such that the belt side edge position is slightly located inner side (measured value of the edge sensor 60 becomes the negative side) before one rotation of the intermediate transfer belt 12 is completed.

Figure 13:
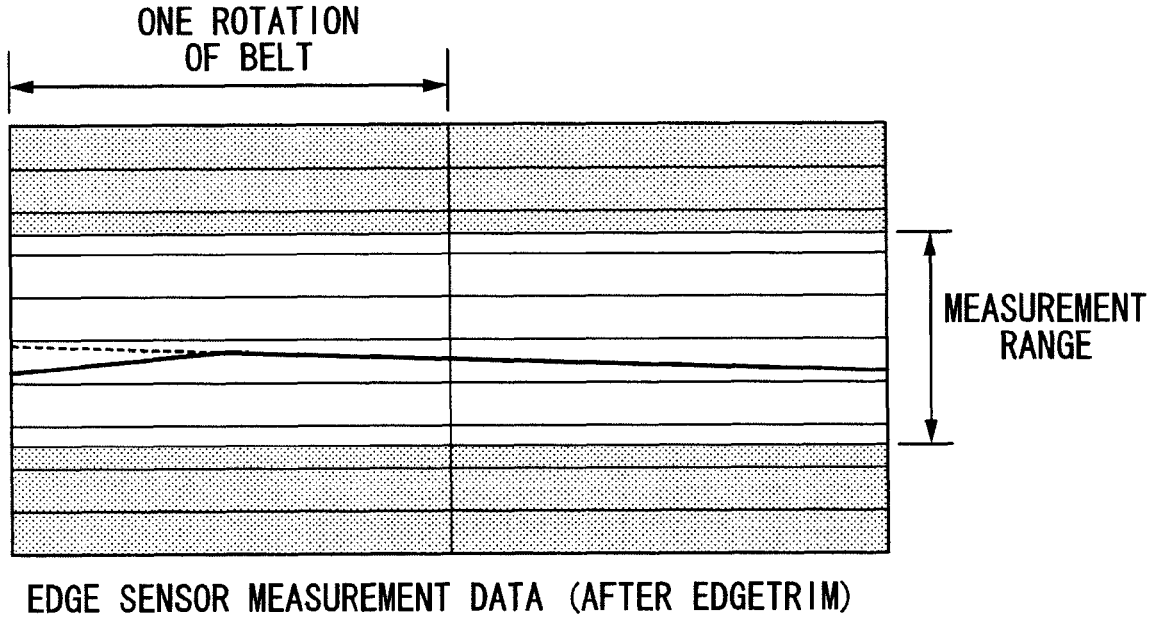
FIG. 13 shows measurement information on the edge sensor of the exemplary embodiment.

As described above, the shape variation of the belt side edge is reduced to decrease the profile component of the belt side edge and, as shown in FIG. 13, the belt side edge position of the intermediate transfer belt 12 does not exceed the measurement range of the edge sensor 60 in the information measured by the edge sensor 60.

The procedure for trimming the belt side edge in the Modification of Procedure noted above may be performed twice. In such cases, after the first trimming of the belt side edge is ended in Step 232, the flow returns to Step 200.

In the case of the second trimming, in Step 204, the control unit 80 performs the comparison to determine the adjustment amount of the inclination of the steering roller 54 using the positional information on the belt side edge. The positional information on the belt side edge is supplied from the edge sensor 60, and the positional information on the belt side edge is larger amount than the time of the first trimming. Therefore, when the belt side edge position is moved outer side or inner side from the start point, the movement amount may be decreased compared with the first trimming, and the intermediate transfer belt 12 is trimmed with high accuracy. Accordingly, the shape error of the belt side edge is further reduced to decrease the profile component of the belt side edge.

The reason why the second trimming can be performed using the larger amount of positional information on the belt side edge than the time of the first trimming is that the outline of the belt side edge falls within the measurement range of the edge sensor 60 by the first trimming of the belt side edge. Desirably, the control unit 80 utilizes all the items of data of the positional information on the belt side edge sequentially supplied from the edge sensor 60.

(Configuration in which Measurement Range of Edge Sensor 60 is Enlarged)

A configuration in which the measurement range of the edge sensor 60 is enlarged will be described below.

In the above-described procedures, when the belt side edge of the intermediate transfer belt 12 is trimmed, it is necessary that the belt side edge position at the start time and the belt side edge position after one rotation of the intermediate transfer belt 12 fall within the measurement range of the edge sensor 60. Desirably, the measurement range of the edge sensor 60 is enlarged such that the belt side edge position surely falls within the positional information of the edge sensor 60.

Figure 14D:
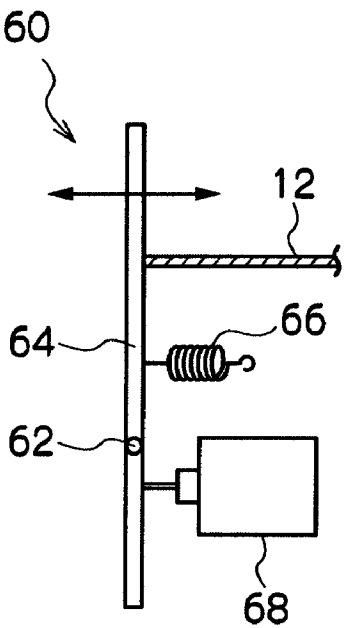
FIGS. 14A to 14D are schematic diagrams showing a configuration in which a measurement range of the edge sensor of the exemplary embodiment is enlarged.
Figure 14C:
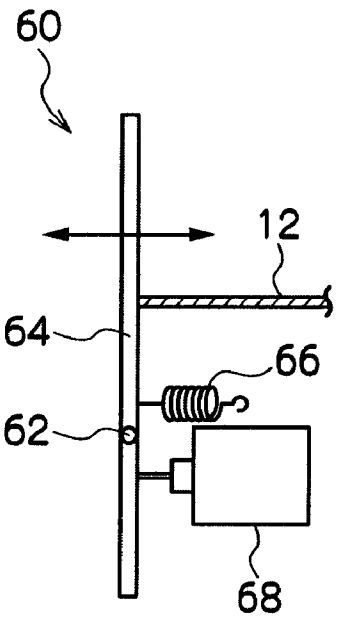
Figure 14B:
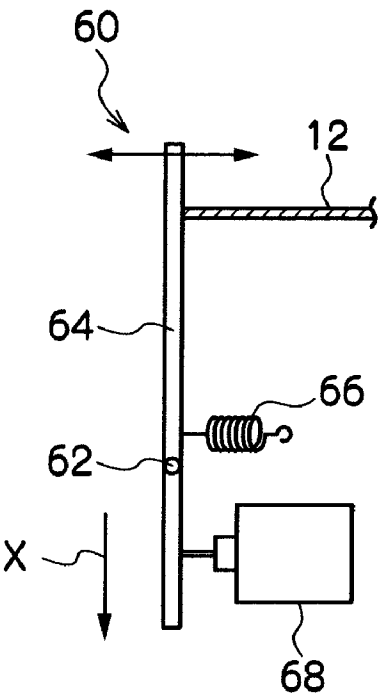
Figure 14A:
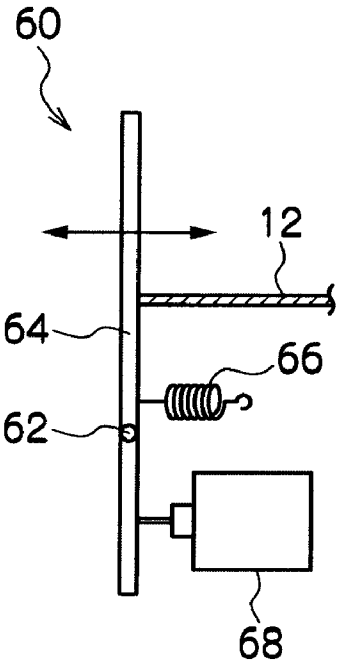

As shown in FIG. 14A, the edge sensor 60 is a sensor in which a lever is utilized, and the edge sensor 60 has a relationship of a point (contact point)=power point at which the arm 64 abuts on the belt side edge, a pivot=fulcrum, and a point of action=a point (contact point) at which the measuring portion 68A of the displacement sensor 68 abuts on the other end portion (lower side of the pivot in FIG. 14A) of the arm 64. The displacement amount of the belt side edge of the intermediate transfer belt 12 is detected as the movement amount of the other end portion of the arm 64 relative to the displacement sensor 68.

In the edge sensor 60 in which the lever is utilized, a distance between a power point and a fulcrum is increased, that is, a distance between the pivot 62 and a region of the arm 64 abutting on the belt side edge is increased, thereby decreasing the movement amount of the other end portion of the arm 64 relative to the displacement sensor 68. That is, the displacement amount of the belt side edge of the intermediate transfer belt 12 is fed into the displacement sensor 68 while downscaled, thereby enlarging the measurement range of the edge sensor 60.

In the edge sensor 60 in which the lever is utilized, a distance between the fulcrum and a point of action is decreased, that is, a distance between the pivot 62 and the other end portion (measurement point of the displacement sensor 68) of the arm 64 is decreased, thereby decreasing the movement amount of the other end portion of the arm 64 relative to the displacement sensor 68. That is, the displacement amount of the belt side edge of the intermediate transfer belt 12 is fed into the displacement sensor 68 while downscaled, thereby enlarging the measurement range of the edge sensor 60.

Specifically, as shown in FIG. 14B, the arm 64, the pivot 62, and the displacement sensor 68 are shifted in a direction (X direction in FIG. 14B) in which the arm 64, the pivot 62, and the displacement sensor 68 are moved away from the intermediate transfer belt 12. Therefore, the distance between the power point and the fulcrum is increased. The configuration of FIG. 14B becomes the effective method in the edge sensor 60 in which the positional relationship among the arm 64, the pivot 62, and the displacement sensor 68 cannot be changed because the arm 64, the pivot 62, and the displacement sensor 68 are integral with one another.

As shown in FIG. 14C, the pivot 62 may be made closer to the side of the displacement sensor 68. This can decrease the distance between the fulcrum and the point of action. Such a configuration becomes an effective method in the edge sensor 60 in which the displacement sensor 68 is separately attached.

As shown in FIG. 14D, the pivot 62 may be close to the side of the displacement sensor 68. Therefore, the distance between the fulcrum and the point of action is decreased while the distance between the power point and the fulcrum is increased. In the edge sensor 60 in which the arm is independently provided, plural attaching holes for the pivot 62 are made, and the attaching position of the pivot 62 may be changed to realize the configuration of FIG. 14D.

The invention is not limited to the exemplary embodiment, but various modifications and changes can be made. The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt rotating apparatus comprising:

a circular belt;

a plurality of rollers about which the belt is entrained, the plurality of rollers including a drive roller which rotates the belt and an inclination change roller which is configured to change its own inclination;

a belt side edge sensor which measures a position of a belt side edge in a belt width direction of the belt;

a cutting unit configured to trim the belt side edge; and a control unit controlling the inclination of the inclination change roller such that the belt side edge is returned to a position in the belt width direction substantially identical to that at a start of rotation after one turn of the belt based on measurement information from the belt side edge sensor, wherein the cutting unit operates to trim the belt side edge which is rotated to return to the position in the belt width direction substantially identical to that at a start of rotation after one turn of the belt according to control of the control unit such that the belt side edge is position within a measurement range of the belt side edge sensor.

2. The belt rotating apparatus of claim 1, wherein the control unit controls a trimming operation of the cutting unit while controlling the inclination of the inclination change roller to adjust meandering of the belt based on measurement information from the belt side edge sensor.

3. The belt rotating apparatus of claim 2, wherein the control unit sets the inclination of the inclination change roller such that the belt side edge is returned to the position substantially identical to that at a start of rotation after one turn of the belt, and the control unit rotates the belt to trim the belt side edge while the cutting unit is operated.

4. A belt rotating apparatus comprising:

a circular belt;

a plurality of rollers about which the belt is entrained, the plurality of rollers including a drive roller which rotates the belt and an inclination change roller which is configured to change its own inclination;

a belt side edge sensor which measures a position of a belt side edge in a belt width direction of the belt;

a cutting unit configured to trim the belt side edge; and a control unit controlling the inclination of the inclination change roller such that a position of the belt side edge is returned to an outer side of a position at a start of rotation after one rotation of the belt based on measurement information from the belt side edge sensor wherein the cutting unit operates to start trimming of the belt side edge which is rotated to return to the outer side the position at a start of rotation after one rotation of the belt according to control of the control unit, and the control unit then changes the inclination of the inclination change roller such that the belt side edge is moved to an inner side after the belt is rotated to start the trimming of the belt, whereby the cutting unit trims the belt side edge such that the belt side edge is positioned within a measurement range of the belt side edge sensor.

5. The belt rotating apparatus of claim 4, wherein, after the belt side edge is trimmed a first time, the control unit sets the inclination of the inclination change roller such that the position of the belt side edge is returned to the outer side of the position at the start of rotation after the one rotation of the belt using positional information on the belt side edge, a larger amount of the positional information on a plurality of belt side edges being used than when the inclination of the inclination change roller was set in the first trimming, after the belt is rotated to start trimming of the belt a second time while the cutting unit is operated, the control unit changes the inclination of the inclination change roller such that the belt side edge is moved to the inner side, whereby the cutting unit trims the belt side edge such that the belt side edge is positioned within a measurement range of the belt side edge sensor.

6. The belt rotating apparatus of claim 3 or 4, wherein the belt side edge sensor can enlarge a measurement range thereof when measuring the position of the belt side edge.

7. The belt rotating apparatus of claim 6; wherein the belt side edge sensor includes:

an arm which is, rotatable about a rotation axis; one of end portions of the arm abutting on the belt side edge;

a biasing member which biases the one of the end portions of the arm against the belt side edge; and a displacement sensor which measures a displacement of the other end portion of the arm, and the measurement range is enlarged by increasing a distance between the rotation axis and a region of the arm abutting on the belt side edge.

8. The belt rotating apparatus of claim 6, wherein the belt side edge sensor includes:

an arm which is rotatable about a rotation axis, one of end portions of the arm abutting on the belt side edge;

a biasing member which biases the one of the end portions of the arm against the belt side edge; and a displacement sensor which measures a displacement of the other end portion of the arm, and the measurement range is enlarged by decreasing a distance between the rotation axis and a measurement point of the displacement sensor.

9. A recording apparatus comprising a transfer belt to which an image is transferred, a photosensitive belt, a conveyance belt conveying a recording medium, a transfer belt rotating apparatus which rotates the transfer belt, a photosensitive belt rotating apparatus which rotates the photosensitive belt, and a conveyance -belt -rotating apparatus which rotates the conveyance belt, wherein at least one of the transfer belt rotating apparatus, the photosensitive belt rotating apparatus, and the conveyance belt rotating apparatus is defined by the belt rotating apparatus of claim 1.

10. A recording apparatus comprising a transfer belt to which an image is transferred, a photosensitive belt, a conveyance belt conveying a recording medium, a transfer belt rotating apparatus which rotates the transfer belt, a photosensitive belt rotating apparatus which rotates the photosensitive belt, and a conveyance belt rotating apparatus which rotates the conveyance belt, wherein at least one of the transfer belt rotating apparatus, the photosensitive belt rotating apparatus, and the conveyance belt rotating apparatus is defined by the belt rotating apparatus of claim 2.

11. A recording apparatus comprising a transfer belt to which an image is transferred, a photosensitive belt, a conveyance belt conveying a recording medium, a transfer belt rotating apparatus which rotates the transfer belt, a photosensitive belt rotating apparatus which rotates the photosensitive belt, and a conveyance belt rotating apparatus which rotates the conveyance belt, wherein at least one of the transfer belt rotating apparatus, the photosensitive belt rotating apparatus, and the conveyance belt rotating apparatus is defined by the belt rotating apparatus of claim 3.

12. A recording apparatus comprising a transfer belt to which an image is transferred, a photosensitive belt, a conveyance belt conveying a recording medium, a transfer belt rotating apparatus which rotates the transfer belt, a photosensitive belt rotating apparatus which rotates the photosensitive belt, and a conveyance belt rotating apparatus which rotates the conveyance belt, wherein at least one of the transfer belt rotating apparatus, the photosensitive belt rotating apparatus, and the conveyance belt rotating apparatus is defined by the belt rotating apparatus of claim 4.

13. A recording apparatus comprising a transfer belt to which an image is transferred, a photosensitive belt, a conveyance belt conveying a recording medium, a transfer belt rotating apparatus which rotates the transfer belt, a photosensitive belt rotating apparatus which rotates the photosensitive belt, and a conveyance belt rotating apparatus which rotates the conveyance belt, wherein at least one of the transfer belt rotating apparatus, the photosensitive belt rotating apparatus, and the conveyance belt rotating apparatus is defined by the belt rotating apparatus of claim 5.

14. A recording apparatus comprising a transfer belt to which an image is transferred, a photosensitive belt, a conveyance belt conveying a recording medium, a transfer belt rotating apparatus which rotates the transfer belt, a photosensitive belt rotating apparatus which rotates the photosensitive belt, and a conveyance belt rotating apparatus which rotates the conveyance belt, wherein at least one of the transfer belt rotating apparatus, the photosensitive belt rotating apparatus, and the conveyance belt rotating apparatus is defined by the belt rotating apparatus of claim 6.

15. A recording apparatus comprising a transfer belt to which an image is transferred, a photosensitive belt, a conveyance belt conveying a recording medium, a transfer belt rotating apparatus which rotates the transfer belt, a photosensitive belt rotating apparatus which rotates the photosensitive belt, and a conveyance belt rotating apparatus which rotates the conveyance belt, wherein at least one of the transfer belt rotating apparatus, the photosensitive belt rotating apparatus, and the conveyance belt rotating apparatus is defined by the belt rotating apparatus of claim 7.

16. A recording apparatus comprising a transfer belt to which an image is transferred, a photosensitive belt, a conveyance belt conveying a recording medium, a transfer belt rotating apparatus which rotates the transfer belt, a photosensitive belt rotating apparatus which rotates the photosensitive belt, and a conveyance belt rotating apparatus which rotates the conveyance belt, wherein at least one of the transfer belt rotating apparatus, the photosensitive belt rotating apparatus, and the conveyance belt rotating apparatus is defined by the belt rotating apparatus of claim 8.

* * * * *